US005284259A

United States Patent [19]

Conway et al.

[11] Patent Number: 5,284,259

[45] Date of Patent: Feb. 8, 1994

[54] TWO SIDED MERCHANDISING STRIP

[75] Inventors: Gerald A. Conway, Cleveland; Daniel J. Kump, Mayfield Heights; David B. Schott, Cuyahoga Falls, all of Ohio

[73] Assignee: Fasteners For Retail, Inc., Cleveland, Ohio

[21] Appl. No.: 864,533

[22] Filed: Apr. 7, 1992

[51] Int. Cl.[5] ..... A47G 29/00

[52] U.S. Cl. ..... 211/73; 211/113; 248/225.1; 206/806; 206/493; 206/482

[58] Field of Search ..... 211/113, 57.1, 59.1, 211/54.1, 86, 73; 206/806, 493, 482; 40/658, 650; 248/225.1

[56] References Cited

U.S. PATENT DOCUMENTS

| | | | |
|---|---|---|---|
| 628,784 | 7/1899 | Fitzgerald . | |
| 1,093,856 | 4/1914 | Hurff . | |
| 1,889,002 | 11/1932 | Palicki | 211/113 |
| 2,211,110 | 8/1940 | Freiler | 211/113 |
| 2,514,742 | 7/1950 | Burger et al. | 211/113 |
| 2,605,000 | 7/1952 | Tomarin | 211/113 |
| 3,398,867 | 8/1968 | Taylor et al. | 211/113 X |
| 3,462,020 | 8/1969 | Hall | 211/73 X |
| 4,312,449 | 1/1982 | Kinderman | 206/482 X |
| 4,373,693 | 2/1983 | Greenberger | 248/221.4 |
| 4,476,983 | 10/1984 | Fast | 211/57.1 |
| 4,477,048 | 10/1984 | Conway | 248/447.1 |
| 4,483,502 | 11/1984 | Fast | 248/222.1 |
| 4,497,464 | 2/1985 | Fast | 248/220.3 |
| 4,546,943 | 10/1985 | Fast | 248/205.3 |
| 4,572,380 | 2/1986 | Langwell | 211/57.1 |
| 4,713,899 | 12/1987 | Fast | 40/10 |
| 4,718,627 | 1/1988 | Fast et al. | 248/225.1 |
| 4,839,977 | 6/1989 | Krautsack | 211/57.1 X |
| 4,911,392 | 3/1990 | Fast | 248/220.3 |

*Primary Examiner*—Blair M. Johnson

*Attorney, Agent, or Firm*—Fay, Sharpe, Beall Fagan, Minnich & McKee

[57] ABSTRACT

A merchandise display strip includes an elongated plastic strip having a mounting portion and an article suspending portion. The article suspending portion includes a first panel, a second panel, and fingers on each of the panels for suspending an article from a respective one of the first and second panels. A fold line separates the first and second panels and enables these panels to be folded in relation to each other so that at least two articles can be supported by the article suspending portion, one from each of the two panels. A third panel is provided on the article suspending portion such that it is interposed between the first and second panels and the mounting portion. The mounting portion enables the merchandise display strip to be supported from a pricing channel, a shelf, or a hook. If desired, the first and second panels can be secured to each other by adhesive, by fasteners or by inter-engaging tabs.

21 Claims, 5 Drawing Sheets

TWO SIDED MERCHANDISING STRIP

BACKGROUND OF THE INVENTION

This invention is directed toward the art of retailing merchandise. The invention relates more particularly to a merchandising strip.

The present invention is especially suited for use in displaying a plurality of blister packs in two spaced vertical alignments in front of a store display shelf and will be described with particular reference thereto. It should, however, be appreciated that the subject invention is capable of broader applications and could be used for displaying merchandise in other environments as well.

Strip merchandisers which display blister packs in a vertically oriented alignment are known. Such display elements are in the form of an elongate plastic strip which is suspended from the front edge of the merchandise display shelf or the like to itself suspend apertured products such as blister packs for display. These strips have a series of superimposed cut-outs or the like which form integral upwardly facing individual support hooks or fingers for the products. At their upper end, the strips have a mounting portion of one form or another for attaching the strip to a shelf. Certain mounting portions are specifically adapted for attachment in a concave price channel of the type often found on the forward edge of display shelves, while other mounting portions are specifically adapted for attachment to a shelf by insertion of an anchor element into an aperture adjacent the forward edge of the shelf.

However, all such merchandising strips have been found inadequate in the sense that they only allow one row of merchandise to be displayed since there is only one row of vertically aligned fingers provided on the strip. Also, the row of merchandise secured to a shelf in an aisle of a store doesn't face a shopper moving down the aisle. The shopper will only be able to determine what goods are being displayed when the shopper is abreast of the merchandising strip.

Accordingly, it has been considered desirable to develop a new and improved merchandising strip which would overcome the foregoing difficulties and others while providing better and more advantageous overall results.

SUMMARY OF THE INVENTION

According to the present invention, a merchandise display strip is provided.

More particularly in accordance with this aspect of the invention, the display strip comprises an elongated strip having a mounting portion and an article supporting portion wherein the article supporting portion comprises a first panel, a second panel, a means for suspending articles from a respective one of the first and second panels, and a fold line that separates the first and second panels. The fold line enables the first and second panels to be folded in relation to each other so that at least two articles can be supported by the article supporting portion, one on each panel.

In accordance with another aspect of the invention, the means for suspending can comprise finger-like members. Preferably a plurality of such finger-like members are located on each of the first and second panels in a vertically spaced alignment.

According to still another aspect of the present invention, fastening means are provided for securing the first and second panels to each other. The fastening means can comprise an adhesive or interlocking portions of the first and second panels or separate fastener members such as staples and the like.

According to yet another aspect of the present invention, the mounting portion can be so configured as to allow the merchandising strip to be secured in a pricing channel, fastened to a shelf by a clip, adhesively secured to a support surface, or hung on a hook as desired.

One advantage of the present invention is the provision of a new and improved merchandising strip.

Another advantage of the present invention is the provision of the merchandising strip which has two adjacent panels that can be folded to lie in different planes so as to allow two rows of vertically spaced merchandise to be displayed in different directions.

Still another advantage of the present invention is the provision of a merchandising strip that includes a mounting portion and an article supporting portion having first and second article suspension panels and an interconnect panel.

Yet another advantage of the present invention is the provision of the merchandising strip having a pair of adjacent panels that can be secured to each other if desired. The panels can be secured to each other in a variety of ways including adhesive, inter-engaging portions or separate fasteners such as staples.

A further advantage of the present invention is the provision of a merchandising strip which has two adjacent panels that face in different directions so that a shopper walking down an aisle in a store, when walking in either direction towards the merchandising strip, will always have one row of merchandise hung from the strip facing the shopper so as to more effectively display the merchandise and entice the shopper to purchase a package of the displayed merchandise.

Still other benefits and advantages of the invention will become apparent to those skilled in the art upon a reading and understanding of the following detailed specification.

BRIEF DESCRIPTION OF THE DRAWINGS

The invention may take physical form in certain parts and arrangements of parts, preferred and alternate embodiments of which will be described in detail in this specification and illustrated in the accompanying drawings which form a part hereof and wherein.

DETAILED DESCRIPTION OF THE PREFERRED AND ALTERNATE EMBODIMENTS

Figure 3:
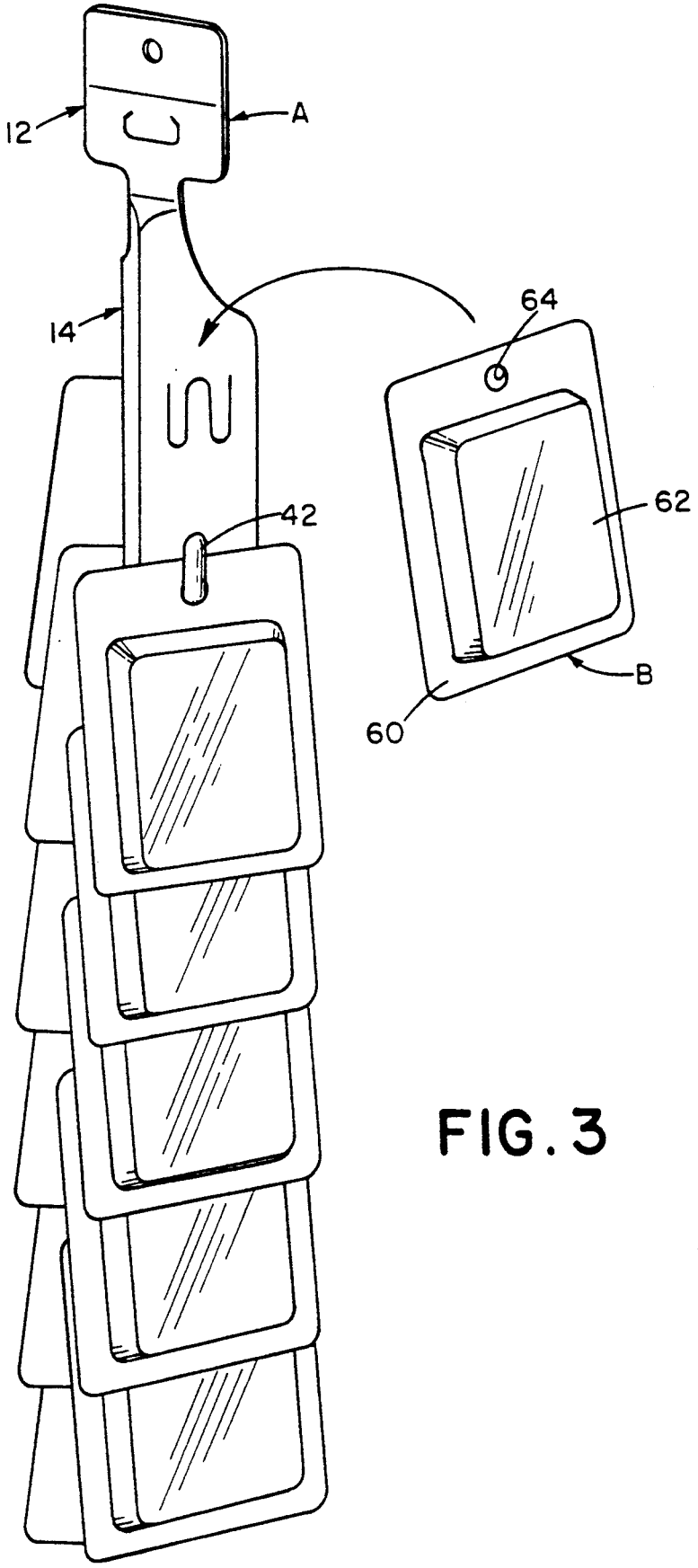
FIG. 3 is a perspective view of the merchandising strip of FIG. 2 having articles suspended therefrom.

Referring now to the drawings Which are for purposes of illustrating the preferred and alternate embodiments of the invention only and not for limiting same, FIG. 3 shows a preferred embodiment of a merchandising strip A which is adapted to hold a plurality of vertically spaced packages B. While the merchandising strip will be illustrated and hereinafter described as cooperating with a particular type of pricing channel and shelf, it should be appreciated that the merchandising strip can also be utilized in other types of merchandising displays in a variety of store environments.

Figure 1:
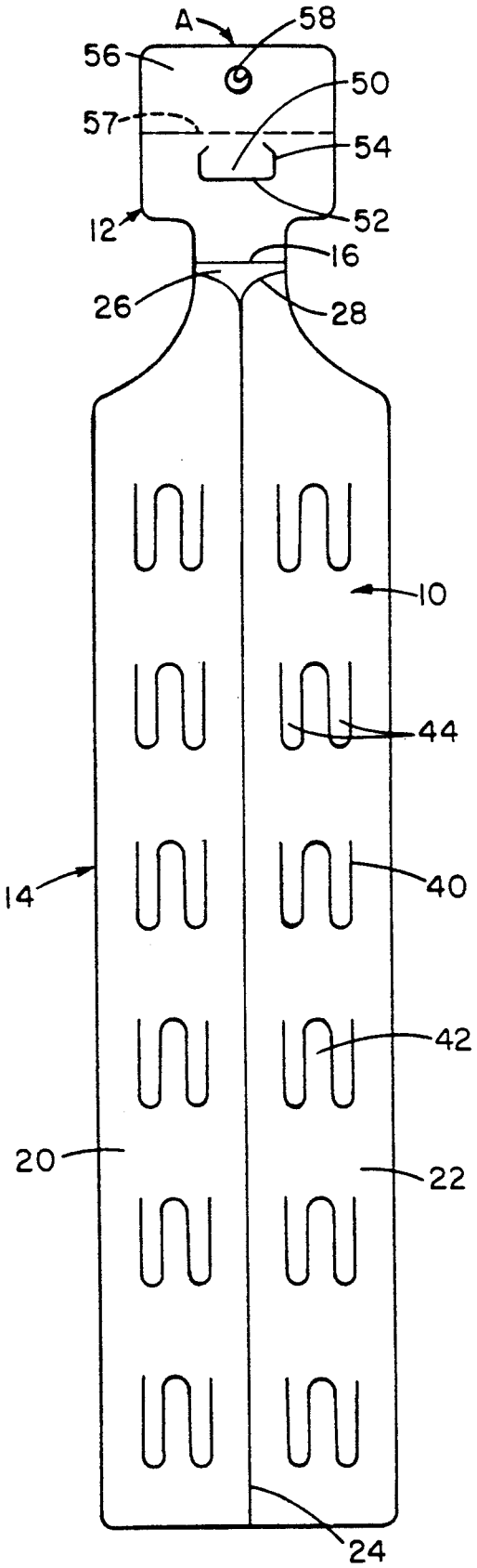
FIG. 1 is a front elevational view of a merchandising strip according to a preferred embodiment of the present invention, with the whole merchandising strip being located in a si plane before the strip is used.

With reference now to FIG. 1, the merchandising strip A includes a body 10, preferably made of a die cut piece of planar plastic material. The body 10 includes a mounting portion 12 and an article suspending portion 14, which are separated from each other by a first fold line 16. The article suspending portion 14 includes a first panel 20 and a second panel 22 that are separated from each other along a second fold line 24. The article suspending portion also includes a third panel 26 which is separated from the first and second panels 20 and 22 along a third fold line 28 and separated from the mounting portion 12 along the first fold line 16.

Defined in each of the first and second panels are a plurality of vertically-spaced somewhat W-shaped slits 40. Each slit defines a centrally located finger or tongue 42 and a pair of side stabilizing fingers 44. As is evident, two rows of such fingers 42 are provided one row extending vertically along the longitudinal centerline of each of the panels 20 and 22.

Figure 4:
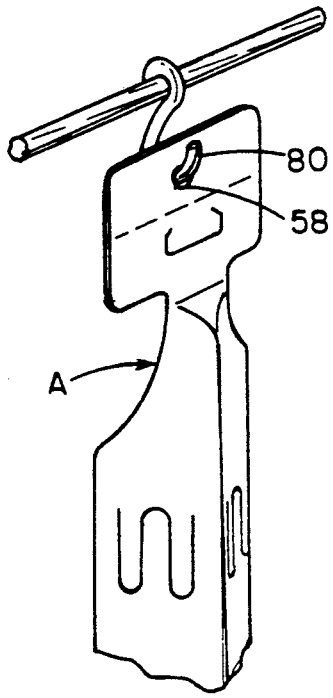
FIG. 4 is a perspective view of a top portion of the merchandising strip of FIG. 1 being suspended from a hook.
Figure 5:
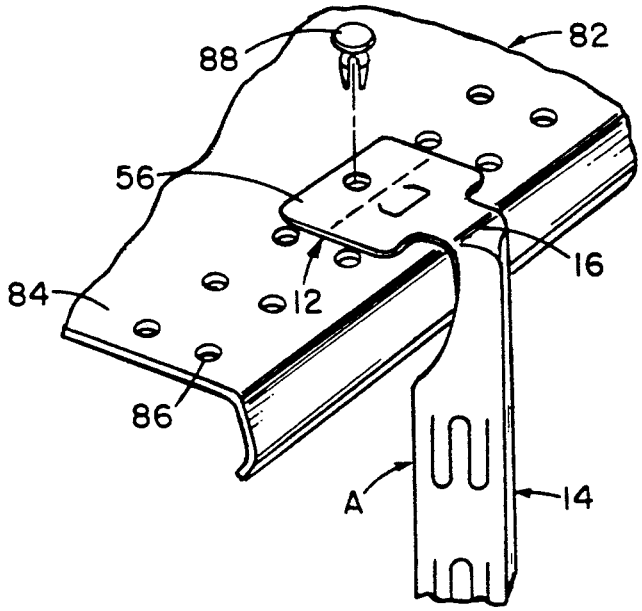
FIG. 5 is a perspective view of a top portion of the merchandising strip of FIG. 1 being secured to a shelf.
Figure 6:
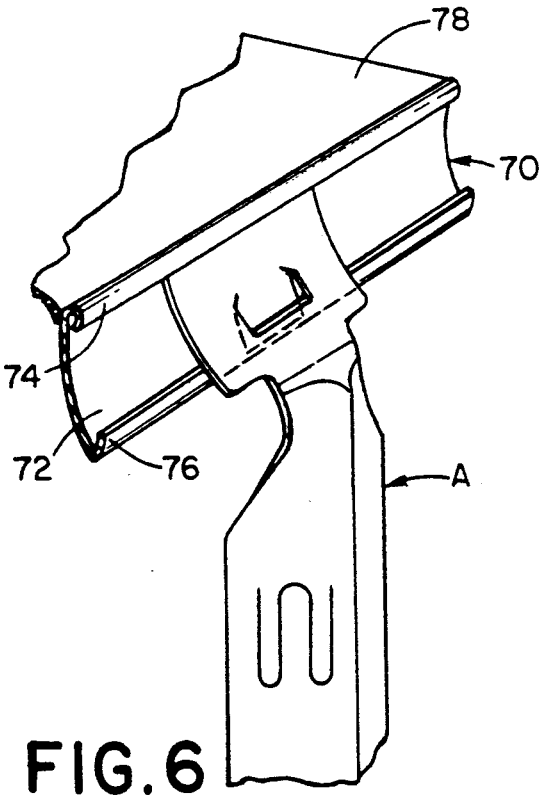
FIG. 6 is a perspective view of a top portion of the merchandising strip of FIG. 1 being secured in a pricing channel.

The mounting portion 12 of the merchandising strip according to the preferred embodiment includes a centrally located tab 50 which is defined by a lower planar edge 52 and a pair of side edges 54. As with the slit 40, the tab 50 can be die cut from the sheet. The side edges 54 defining the tab can include upwardly and inwardly directed end portions. These reduce the integral connection of the tab to the main body of the mounting portion at the upper end of the tab, thus enhancing the flexibility of the tab or its ability to be deflected from the plane of the mounting portion while maintaining a lower edge of substantial width along a straight line. This will prove useful when the tab is engaged in a pricing channel as is illustrated in FIG. 6. The mounting portion 12 also includes an adhesive section 56 located on a back side of the planar mounting portion. The adhesive section 56 can extend from a top edge of the mounting portion 12 down to a line 57 located above the tab 50. Extending through the upper section of the mounting portion 12 is a through aperture 58. This is useful for either mounting the merchandising strip A on a hook as is illustrated in FIG. 4, or for securing a fastener therethrough as is illustrated in FIG. 5.

Figure 2:
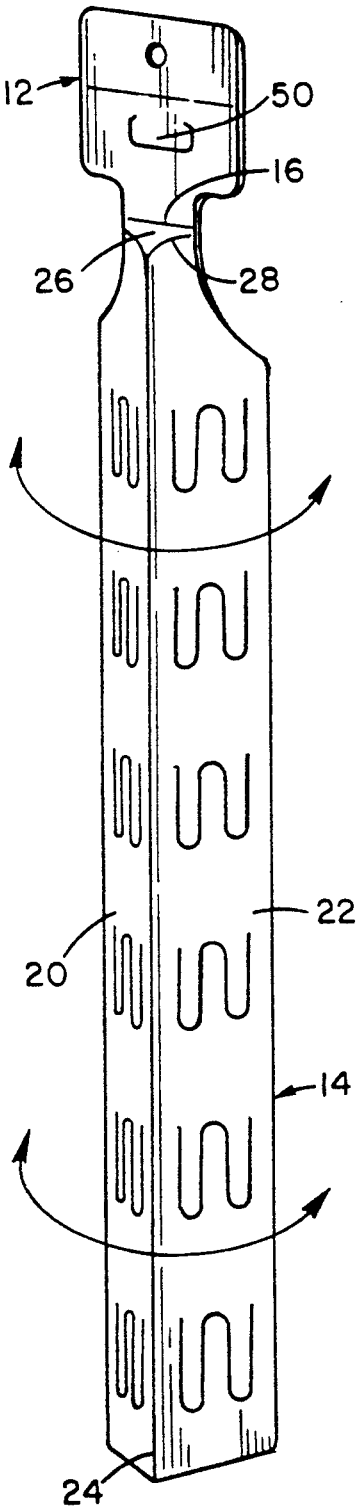
FIG. 2 is a perspective view of the merchandising strip of FIG. 1 with a pair of panels being folded in relation to each other.

With reference now to FIG. 2, the planar sheet illustrated in FIG. 1 is folded for use. For this purpose, the two panels 20 and 22 are folded in relation to each other along the second fold line 24. At this point, both of the panels 20 and 22 of the item suspending portion 14 leave the plane of the mounting portion 12. In order to successfully accomplish this purpose, the third panel 26 becomes somewhat forwardly angled around the first fold line 16 so that the third panel 26 also leaves the plane of the mounting portion 12. As can be seen, the third fold line 28 includes two curved lines which come together somewhat like the top half of the letter Y to intersect the second fold line 24. It can be noted that while the first and second panels 20 and 22 are positioned at an angle to each other, the third panel 26 is positioned at an angle to both of the first and second panels. The third panel 26 is located in a plane which is substantially normal to the planes of the first and second panels 20 and 22.

With reference now to FIG. 3, when the two panels 20 and 22 of the merchandising strip are folded, two vertically oriented rows of packages B can be secured to the fingers 42 defined on the two panels. Each of the packages B can include a planar card member 60 having a blister pack 62 secured thereto. The card includes a hole 64 through which the finger or tongue 42 of the merchandising strip can extend in order to secure the package to the strip.

With the embodiment of FIG. 3, it can be seen that the two rows of packages B face in opposite directions. When a shopper is walking down the aisle of a store in which the merchandising strip A is secured to a shelf, the shopper will have a fairly head-on view of the packages displayed on the merchandising strip since the strip is positioned at an angle to the shelf to which it is secured. This is advantageous over the known merchandising strips since those strips are all located in the plane of the front face of the shelf to which they are secured. Therefore, the known merchandising strips do not present the shopper walking past a frontal view of the merchandise being displayed, but only a side view thereof, until the shopper is directly in front of the known merchandising strips. In contrast, the merchandising strip of the present invention always presents a somewhat frontal view of the articles being displayed to the shoppers walking past, whether they are walking towards the merchandising strip from either a left or a right direction along an aisle in which the strip is secured. Thus the shopper will view the merchandise for a longer period of time and that may entice the shopper to purchase the product being displayed.

With reference now to FIG. 6, the merchandising strip A can be secured in a pricing channel 70 which includes a concave channel section 72 as well as an upper flange 74 and a lower flange 76. The mounting portion 12 of the merchandising strip A can be snapped into the pricing channel 70, which is located at the front end of a display shelf 78. Such pricing channels are normally utilized for the insertion of identification and pricing information with respect to items displayed on the shelf thereabove. The pricing information is generally inserted in the pricing channel by snapping display information therein or sliding such information in from the end. As is illustrated in FIG. 6, the upper edge of the mounting portion 2 can be snapped into the pricing channel. Thereafter, the tab 50 can be deflected backwardly out of the plane of the mounting portion so that the lower edge 52 thereof is located behind the lower flange 76 of the pricing channel 70. In this way, the merchandising strip is suspended from the pricing channel 70. Preferably, the body 10 of the merchandising strip is made from a transparent plastic material. The transparent nature of the strip is advantageous in order to allow any pricing information displayed behind the mounting portion 12 to be readily visible.

With reference now to FIG. 4, the merchandising strip A ca also be suspended from a suitable hook 80 which extends through the aperture 58 in the mounting portion 12. Alternately, as is illustrated in FIG. 5, the mounting portion can be bent along the first fold line 16 to place the mounting portion 12 in a plane at right angles to the article suspending portion 14. Thereafter, the merchandising strip A can be positioned on a shelf 82 having a horizontal surface 84 and transverse apertures 86 extending therethrough adjacent the front edge of the shelf. A suitable known clip 88 can extend through colinear apertures 58 in the mounting portion 12, and 86 in the shelf 82, in order to fasten the merchandising strip to the shelf.

If desired, the adhesive section 56 of the mounting portion 12 can also be utilized at this time. Alternately, the merchandising strip A can be fastened to a support surface merely by use of the adhesive section 56 if so desired.

Figure 7:
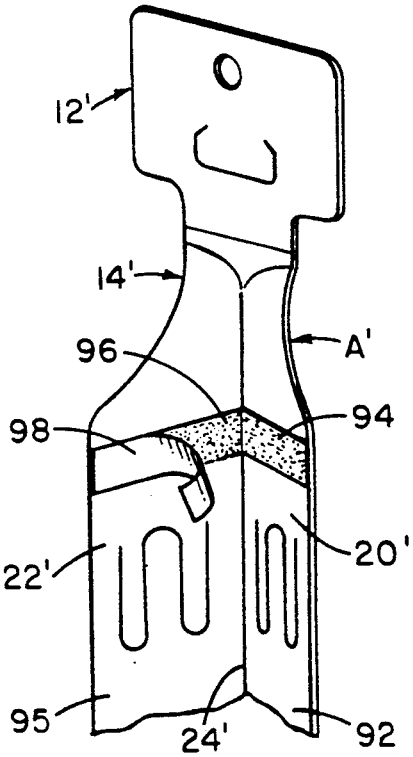
FIG. 7 is a rear perspective view of a top portion of a merchandising strip illustrating a first way of securing a pair of panels of the merchandising strip to each other according to a first alternate embodiment of the present invention.

With reference now to FIG. 7, a first means for securing the two panels of the article suspension portion of the merchandising strip is there illustrated. For ease of appreciation and comprehension of this alternative, like components are identified by like numerals with a primed (') suffix and new components are identified by new numerals.

A merchandising strip A' includes an article suspending portion 14' having a first panel 20' and a second panel 22'. Located on a rear side 92 of the first panel 20 is a first adhesive section 94. Located on a rear side 95 of the second panel 22' is a second adhesive section 96. A liner strip 98 can cover the adhesive sections 96 and 94 before they are put to use. When the two panels 20' and 22' are folded along a second fold line 24', the liner 96 can be removed. Thereafter, the adhesive sections 94 and 96 can be made to overlie each other and can be secured to each other so as to secure the panels 20' and 22' to each other.

It may be advantageous to secure the two panels to each other if it is desired to have the merchandising strip A' take up as little room as possible in width. When the two panels 20' and 22' are secured to each other, the panels lie in a plane which is perpendicular to the plane of the mounting portion 12' of the merchandising strip A' and perpendicular to the top surface of a shelf to which the merchandising strip A' is secured. Accordingly, the merchandise held on the strip A' will be directly facing a shopper walking down the aisle of a store in which the strip is used so as to allow the shopper a full frontal view of the articles suspended from the merchandising strip A'. This is true whether the shopper is approaching the merchandising strip A' from either the left or the right direction because packages are hung from both sides of the strip.

Figure 8:
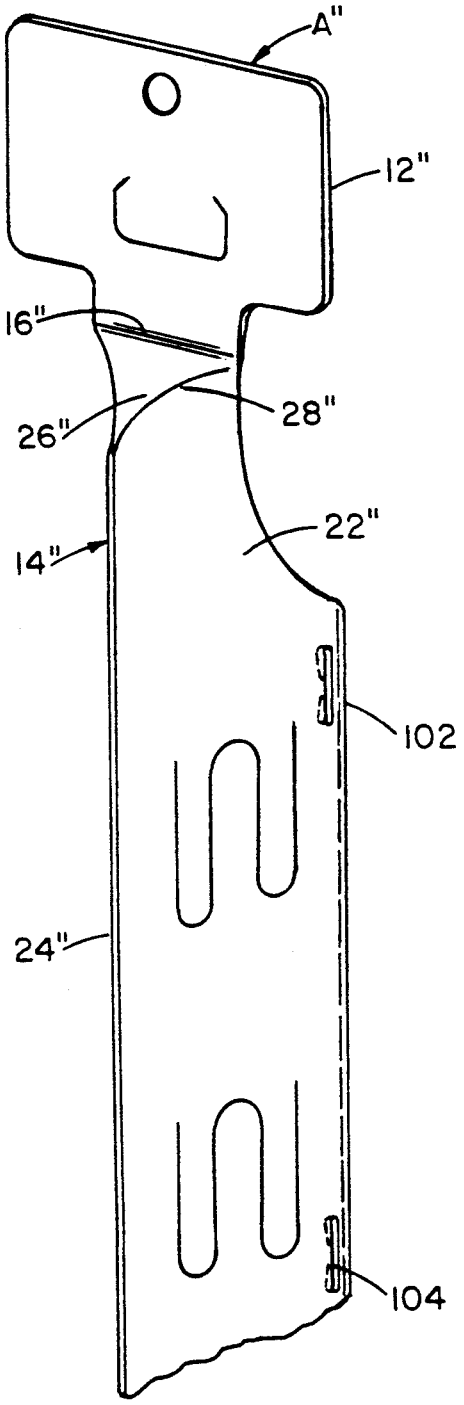
FIG. 8 is a perspective view of a merchandising strip illustrating a second way for securing a pair of panels of the merchandising strip to each other according to a second alternate embodiment of the present invention.

It should be appreciated that other means for securing the two panels to each other can also be provided. With reference now to FIG. 8, another such means is illustrated. For ease of appreciation and comprehension of this alternative, like components are identified by like numerals with a double-primed (") and new components are identified by new numerals.

In FIG. 8, a merchandising strip A" includes a mounting portion 12" and an article suspending portion 14" that has a first panel (not visible) and a second panel 22". The panels are separated along a second fold line 24". The two panels are secured to each other by suitable fasteners which may be in the form of spaced staples 102 and 104 as illustrated. It should be appreciated, however, that other types of fasteners can also be utilized. It is evident from FIG. 8 that the first and second panels are located in a different plane from a third panel 26" which is delineated from the mounting portion 12" by the first fold line 16" and is delineated from the first and second panels by a third fold line 28". A somewhat triangular-shaped third panel 26" is formed in this manner. It is evident that the third panel is necessary in order to ensure that the mounting portion 12" can be oriented in a plane perpendicular to the plane in which the first and second panels are located.

Figure 9:
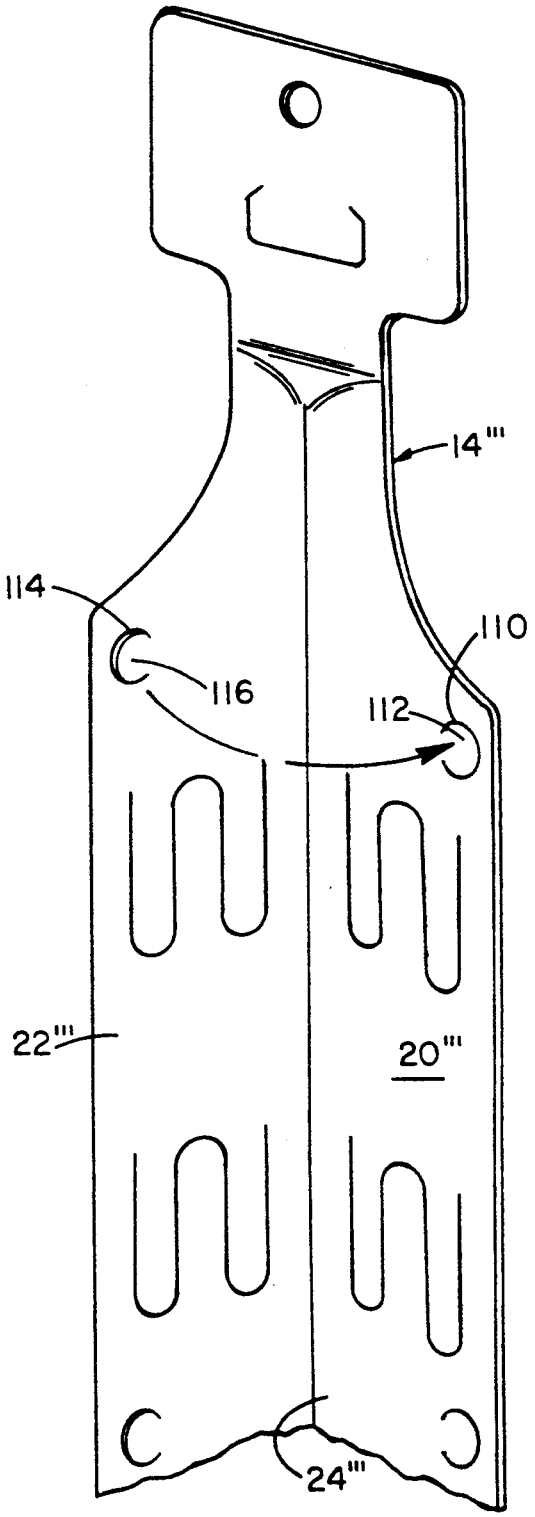
FIG. 9 is a rear perspective view of a merchandising strip illustrating inter-engaging members for securing a pair of panels of a merchandising strip to each other according to a third alternate embodiment of the present invention.

With reference now to FIG. 9, yet another means for securing the two panels to each other is illustrated. For ease of appreciation and comprehension of this alternative, like components in FIG. 9 will be identified by like numerals with a triple-primed (''') suffix and new components will be identified with new numerals.

In FIG. 9, a pair of panels 20''' and 22''' of an article suspending portion 14''' of a merchandising strip are separated along a fold line 24'''. Located on the first panel 20''' is a first slit 110 which is somewhat C-shaped so as to define a tab 112 that can be bent away from the plane of the panel. Located on the second panel 22''' is a second somewhat C-shaped slit 114 which defines a second tab 116. When the panels are brought into an adjoining relationship, the tab 16 of the second panel can be pushed through the plane of the first panel at the tab 112 so as to secure the two panels to each other. In other words, suitable inter-engaging portions, which can take a number of different shapes, can be die cut into the two panels in order to allow the panels to be secured to each other.

Figure 10:
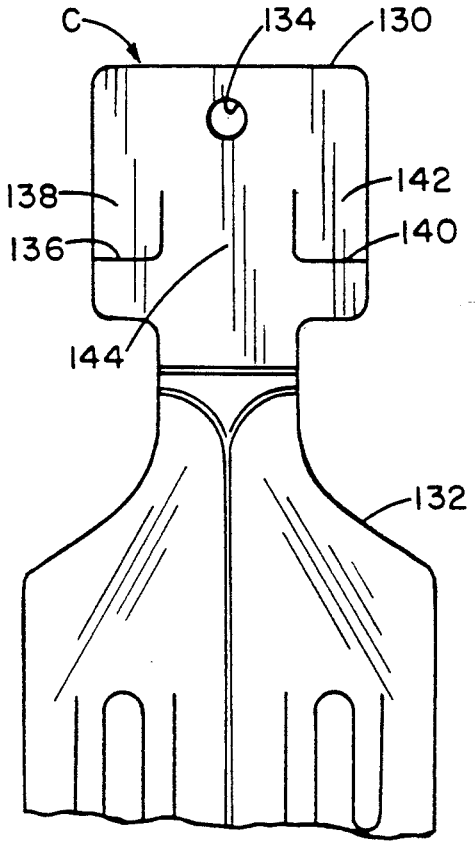
FIG. 10 is a perspective view of a top portion of a merchandising strip illustrating a mounting portion according to a first alternate embodiment of the present invention.
Figure 11:
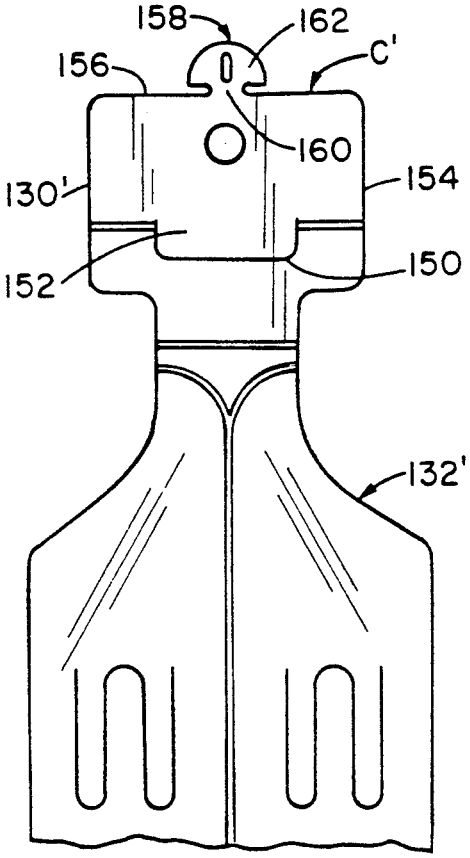
FIG. 11 is a front elevational view of a top portion of a merchandising strip illustrating an alternative mounting portion according to a second alternate embodiment of the invention; and, FIG. 12 is a front elevational view of an upper portion of the merchandising strip illustrating a mounting portion according to a third alternate embodiment of the present invention.
Figure 12:
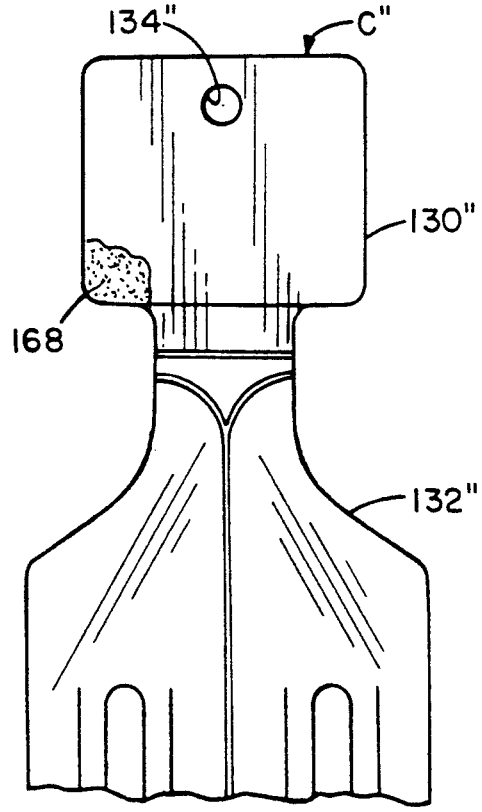

With reference now to FIGS. 10–12, different types of mounting portions for a merchandising strip are there described. With reference particularly to FIG. 10, a merchandising strip C includes a mounting portion 130 and an article suspending portion 132. Provided in the mounting portion is a first slit 136 that extends inwardly from a side edge of the mounting portion so as to define a first tab 138. Extending from an opposing side edge of the mounting portion is a second slit 140 that defines a second tab 142. The two tabs can be flexed away from the plane of the mounting portion so as to allow the mounting portion to be snapped into a price channel as was illustrated in FIG. 6. In this embodiment, the two tabs are located to the rear of a central neck portion 144 of the mounting portion when the tabs are snapped into the price channel.

With reference now to FIG. 11, another alternate embodiment of a mounting portion is there illustrated. For ease of comprehension and appreciation of this alternative, like components are identified by like numerals with a primed suffix (') and new components are identified by new numerals.

In this embodiment, a somewhat U-shaped slit 150 is provided in the middle of a mounting portion 130' so as to define a centrally located tab 152. Extending from the upper edges of the slit 150 to the side edges of the mounting portion 130' are a pair of fold lines 154. Located on an upper edge 156 of the mounting portion 130' is an anchor member 158. The anchor member is defined by a neck 160 and a transversely widened anchor portion 162 extending therefrom. The anchor member 158 can have its sides or wings folded together so as to allow the anchor to be inserted in a suitable hole in a store shelf such as the apertured shelf illustrated in FIG. 5. When so secured, it is evident that the mounting portion or at least the upper half thereof, as delineated by the fold lines 154 and the slit 150, is located in a plane extending at a right angle to a plane intersecting the article suspending portion 132'.

Finally, yet another alternative of a mounting portion is illustrated in FIG. 12 of the drawings. For ease of comprehension and appreciation of this alternative, like components are identified by like numerals with a double-primed suffix (") and new components are identified by new numerals.

In this embodiment, a mounting portion 130" of a merchandising strip C" has located thereon a layer of adhesive material 168. The adhesive can extend over the entirety of the mounting portion 130" if so desired. In this way, the merchandising strip C", including an article suspending portion 132", can be secured simply by means of the adhesive material to a suitable support surface. Alternatively, an aperture 134" extending through the mounting portion 130" can be utilized to suspect the merchandising strip by projecting a fastener or a hook therethrough.

The invention has been described with reference to preferred and alternate embodiments. It should be appreciated that alterations and modifications will occur to those of average skill in the art upon the reading and understanding of this specification. It is intended to include all such modifications and alterations as they come within the scope of the attached claims or the equivalents thereof.

Having thus described the present invention, it is now claimed:

1. A merchandise display strip comprising:

an elongated plastic strip having a mounting portion and an article suspending portion, wherein said article suspending portion comprises a first panel, a second panel, a means for suspending an article from a respective one of said first and second panels and a longitudinally extending fold line separating said first and second panels, wherein said longitudinally extending fold line enables said first and second panels to be folded in relation to each other so that at least two articles can be supported by said article suspending portion, one on each panel, a transversely extending fold line disposed between said mounting portion and said article suspending portion wherein said transversely extending fold line enables said mounting portion to be displaced from a plane of said article suspending portion and wherein said article suspending portion further comprises a third panel interposed between said first and second panels and said transversely extending fold line.

2. The strip of claim 1 further comprising a scalloped fold line separating said third panel from said first and second panels.

3. The strip of claim 1 wherein said means for suspending an article comprises a finger-like member having a proximal end which is secured to said panel and a distal end which can be spaced away from a plane of its panel by bending said finger-like member.

4. The strip of claim 3 wherein a plurality of such finger-like members are located on each of said first and second panels, said finger-like members being located in a vertically spaced alignment.

5. The strip of claim 1 further comprising a fastening means for securing said first and second panels to each other.

6. The strip of claim 5 wherein said fastening means comprises an adhesive.

7. The strip of claim 5 wherein said fastening means comprises portions of said first and second panels.

8. The strip of claim 5 wherein said fastening means comprises a separate fastener member.

9. The strip of claim 1 wherein said mounting portion comprises a planar body having a horizontally oriented upper edge and a pair of side edges and a centrally located tab provided in said planar body, said tab having a horizontally oriented lower free edge and a pair of side edges, said tab being capable of being flexed away from a plane of said mounting portion so as to allow said mounting portion to be snapped into a pricing channel of an associated merchandise display shelf.

10. The strip of claim 1 wherein said mounting portion comprises a through hole which permits a fastener extending therethrough to secure the strip to a support structure.

11. The strip of claim 1 wherein said mounting portion comprises an adhesive section located on a surface of said mounting portion to permit the strip to be adhered to a support structure.

12. The strip of claim 1 wherein said mounting portion comprises a planar section and an anchor member extending from said planar section said anchor member comprising a stem portion terminating in a transversely widened anchor portion.

13. The strip of claim 1 wherein said mounting portion comprises a planar section having a horizontally oriented upper edge, a pair of side edges and a pair of horizontally oriented lower edge segments defining therebetween a stem portion, said upper edge and said pair of lower edges being capable of being flexed so as to allow said mounting portion to be snapped into a pricing channel of an associated merchandise display shelf.

14. A merchandise display strip made of an elongated planar strip material, comprising:

a mounting portion and an article suspending portion separated along a first fold line wherein said article suspending portion comprises:

a first panel including a first article suspending means, a second panel including a second article suspending means, a second fold line separating said first and second panels, wherein said second fold line enables said first and second panels to be folded in relation to each other so that said panels are located in different planes and wherein at least two article can be supported by said article suspending portion, one suspended from each of said first and second article suspending means, and a third panel interposed between said first and second panels and said first fold line.

15. The strip of claim 14 wherein said first and second article suspending means each comprise a plurality of finger-like members each having a proximal end which is secured to said panel and a distal end which can be spaced away from a plane of its panel by bending said finger-like member at said distal end, wherein said finger-like members are located on each of said panels in a vertically spaced alignment.

16. The strip of claim 14 wherein said mounting portion comprises a planar body having a horizontally oriented upper edge and a pair of side edges and a centrally located tab provided in said planar body, said tab having a horizontally oriented lower free edge and a pair of side edges, said tab being capable of being flexed away from a plane of said mounting portion so as to allow said mounting portion to be snapped into a pricing channel of an associated merchandise display shelf.

17. The strip of claim 14 wherein said mounting portion comprises a through hole, which permits a fastener extending therethrough to secure the strip to a support structure.

18. The strip of claim 14 further comprising a third fold line separating said third panel from said first and second panels.

19. The strip of claim 18 wherein said second fold line intersects at one end said third fold line.

20. A merchandise display strip comprising:

an elongated plastic strip having a mounting portion and an article suspending portion;

a first fold line disposed between said mounting portion and said article suspending portion, wherein said first fold line enables said mounting portion to be displaced from a plane of said article suspending portion; and, wherein said article suspending portion comprises:

a first panel, a second panel, a third panel interposed between said first and second panels and said first fold line, an article suspending means secured to each of said first and second panels, and a second fold line separating said first and second panels, wherein said second fold line enables said first and second panels to be folded in relation to each other so that at least two articles can be supported by said article suspending means, one on each panel, said articles being located in different planes.

21. The strip of claim 20 wherein said article suspending means for each of said first and second panels comprises a plurality of finger-like members each having a proximal end which is secured to its respective panel and a distal end which can be spaced away from a plane of its respective panel by bending said finger-like member at said distal end, wherein said finger-like members are located on each of said first and second panels in a vertically spaced alignment.

* * * * *